US006000695A

United States Patent [19]

Mack et al.

[11] Patent Number: 6,000,695

[45] Date of Patent: Dec. 14, 1999

[54] DEVICE FOR THE TRANSPORT AND DEPOSIT OF SHEETS IN A STACKING REGION OF A ROTARY PRESS

[75] Inventors: Richard Burkhard Mack, Bruehl; Erich Michael Zahn, Eppelheim, both of Germany

[73] Assignee: Heidelberger Druckmaschinen AG, Heidelberg, Germany

[21] Appl. No.: 08/583,065

[22] PCT Filed: Jun. 30, 1994

[86] PCT No.: PCT/EP94/02139

§ 371 Date: Mar. 11, 1996

§ 102(e) Date: Mar. 11, 1996

[87] PCT Pub. No.: WO95/01930

PCT Pub. Date: Jan. 19, 1995

[30] Foreign Application Priority Data

Jul. 5, 1993 [DE] Germany ..... 43 22 324

[51] Int. Cl.[6] ..... B65H 39/10

[52] U.S. Cl. ..... 271/303; 271/69; 271/309; 271/183; 271/195; 271/196; 271/211

[58] Field of Search ..... 271/303, 69, 309, 271/183, 195–197, 211; 101/240, 232

[56] References Cited

U.S. PATENT DOCUMENTS

| | | | |
|---|---|---|---|
| 3,659,840 | 5/1972 | Ruck . | |
| 3,889,801 | 6/1975 | Boyer . | |
| 3,972,523 | 8/1976 | Brandes . | |
| 4,111,411 | 9/1978 | Graves et al. | 271/303 X |
| 4,317,563 | 3/1982 | Zimmermann et al. . | |
| 4,449,453 | 5/1984 | Staffer et al. . | |
| 4,572,071 | 2/1986 | Cappel et al. . | |
| 5,060,928 | 10/1991 | Vits . | |
| 5,102,118 | 4/1992 | Vits . | |
| 5,222,726 | 6/1993 | Vits . | |
| 5,259,608 | 11/1993 | Pollich | 271/183 |
| 5,263,415 | 11/1993 | Pollich . | |
| 5,607,148 | 3/1997 | Mack et al. | 271/303 |

FOREIGN PATENT DOCUMENTS

| | | |
|---|---|---|
| 370 381 | 3/1983 | Austria . |
| 536 456 | 10/1931 | Germany . |
| 714 974 | 12/1941 | Germany . |
| 937 106 | 12/1955 | Germany . |
| 1 148 241 | 5/1963 | Germany . |
| 1 921 315 | 3/1971 | Germany . |
| 2 402 239 | 8/1974 | Germany . |
| 24 02 435 | 7/1975 | Germany . |
| 30 37 376 | 4/1981 | Germany . |
| 24 53 753 | 5/1982 | Germany . |
| 36 29 720 | 4/1987 | Germany . |
| 36 38 494 | 8/1987 | Germany . |
| 34 11 029 | 10/1987 | Germany . |
| 34 43 704 | 7/1988 | Germany . |
| 31 43 089 | 2/1989 | Germany . |
| 39 12 459 | 11/1989 | Germany . |
| 30 01 395 | 2/1990 | Germany . |
| 38 41 909 | 9/1990 | Germany . |
| 39 36 846 | 4/1991 | Germany . |
| 296 053 | 11/1991 | Germany . |
| 40 12 943 | 3/1992 | Germany . |
| 90 07 513 | 4/1992 | Germany . |
| 41 06 904 | 12/1992 | Germany . |
| 92 14 459 | 3/1993 | Germany . |
| 41 32 198 | 4/1993 | Germany . |
| 41 38 280 | 5/1993 | Germany . |
| 41 40 253 | 6/1993 | Germany . |
| 39 20 407 | 7/1993 | Germany . |
| 42 13 024 | 10/1993 | Germany . |
| 939 304 | 6/1982 | U.S.S.R. . |
| 901 906 | 7/1962 | United Kingdom . |
| 1 442 910 | 7/1976 | United Kingdom . |
| 2 009 714 | 6/1979 | United Kingdom . |
| 2 013 629 | 8/1979 | United Kingdom . |

*Primary Examiner*—David H. Bollinger
*Attorney, Agent, or Firm*—Herbert L. Lerner; Laurence A. Greenberg

[57] ABSTRACT

A device for the transport and deposit of sheets in a stacking region is provided. The device includes pneumatic guiding elements below the conveying path and extending across the entire width. A chain-conveyor system and a pneumatic conveyor system following the chain-conveyor system are provided. The devices also provides for selectable paths to plural delivery positions.

14 Claims, 4 Drawing Sheets

DEVICE FOR THE TRANSPORT AND DEPOSIT OF SHEETS IN A STACKING REGION OF A ROTARY PRESS

BACKGROUND OF THE INVENTION

Field of the Invention

The invention relates to a device for the transport and deposit of sheets in a stacking region of a rotary press with pneumatic sheet-guiding elements disposed below a sheet-conveying path, said sheet-guiding elements extending across the entire width of each sheet and with a chain-conveyor system, said chain-conveyor system accepting the sheets consecutively from a last sheet-conducting cylinder of the sheet-fed rotary printing press, transporting them along a conveying distance in a main conveying direction directed towards a stack apparatus and releasing them on a stack base in the stack apparatus in order to form a stack.

Such an apparatus is already known from DE 36 29 720 A1, wherein blast-air-activated sheet-guide bars are disposed in the sheet-conveying direction, outer sheet-guide bars each being limited by a suction tube. Starting from the central sheet-guide bar, which distributes blast air on either side, there is formed between the individual sheet-guide bars and the outside-disposed suction tubes a tangentially directed flow field, which stretches the sheets being transported, starting from the centre, transversely with respect to the sheet-conveying direction. Such an arrangement may lead to the setting-off of ink on the upper sections of the sheet-guide bars, particularly in the case of the delivery of face-and-back-printed copies. Furthermore, this solution from the prior art has the disadvantage that gripper bars, carried by revolving gripper chains, are guided over the delivery stack, with the result that, for example, the removal of an inspection sheet represents something of a risk of injury for the printer.

Known from DE 38 41 909 C2 is a process and a device for the floatation-guiding of sheets or web-form material over a conveying distance, particularly a curved conveying distance along one chain side of a chain-conveyor system. Disposed underneath an initially concavely curved and thereafter convexly curved conveying path is a multiplicity of nozzle boxes, separated from each other by suction shafts. Since the partial vacuum acting in the suction shafts replaces the air cushions produced by the open jets escaping from the nozzle boxes, there results a wave-shaped guiding of the material that is to be transported. Provided on the side of the sheets facing away from the nozzle boxes is a plurality of open-jet nozzles, which act from said side on the sheets to be transported. Additionally formed on the conveying chain are blades on which is formed a flow shadow before the sheets enter a duct, formed by a partition wall, with narrowing cross section. Also in this known device, the chain-conveyor system extends over the stack and there are no special measures for the smear-free deposition of the sheets on the stack.

The outlined solutions from the prior art have the common disadvantages that revolving chain systems extend over the stacking region of the sheets, that said chain systems considerably restrict the inspectability of said stacking region and the accessibility thereof and that the removal of an inspection sheet harbours a risk of injury owing to the revolving chain systems.

SUMMARY OF THE INVENTION

Proceeding from the above-described prior art, the object of the invention is to form a device of the initially mentioned kind such that there is a user-friendly possibility for the removal of sheets that have been output from the press.

The object of the invention is achieved in that the chain-conveyor system releasing the sheets is followed by a pneumatic conveyor system equipped with a copy diverter, said conveyor system transporting the sheets released by the chain-conveyor system into a stacking position—said stacking position being situated in the region of the stack apparatus and being selectable by means of the copy diverter—and allowing the sheets to drop onto a stack level associated with the selected stacking position.

The advantages achievable by means of this design are of a diverse nature. Firstly, there is a considerable degree of facilitation for the printer through the fact that, after a new job has been set up, the reject sheets occurring during the proof-printing phase can be immediately separately collected, such collection being performed automatically on a special stack level selected for that purpose and separated from the top side of the stack. Furthermore, it is no longer necessary to intervene in the continuous delivery process of the sheets onto a stack, since inspection sheets can likewise be transported onto a separate stack level. The transport of the sheets by means of aerodynamically produced forces into a particular stack position guarantees the smear- and scratch-free deposition of the sheets on the stack.

The design according to the invention further permits the delivery of output sheets while avoiding moving parts, such as gripper bars, in the immediate vicinity of an operator station at a sheet delivery. The arrangement of a plurality of stack levels at the end of the process line offers an easily accessible and easily inspectable delivery possibility, both for reject copies during the startup phase and also for inspection copies during the production run.

A further development of the basic idea of the invention is characterized in that a first stack level is provided above a second stack level, said second stack level being formed by the top side of the stack or the stack base. This advantageously provides an extremely space-saving arrangement for the optional deposition of the sheets on the delivery stack or on a stack level separate therefrom.

The above-mentioned basic idea lies in particular in an abandonment of the principle (employed in conventional devices of this type) of a self-contained functional unit in which the sheets are deposited by the same transport means that accept the sheets from a last sheet-conducting cylinder of a sheet-fed rotary printing press. This basic idea is pursued further by the invention in that a gripperless functional unit is attached to a chain-conveyor system of a device of the above-mentioned kind.

In continuation of the idea forming the basis of the invention, it is provided that the pneumatic conveyor system comprises floatation-guiding means associated with each stacking position, said floatation-guiding means guiding a sheet, leaving the copy diverter, by means of an air stream between a top side of the sheet and the floatation-guiding means—said air stream being produced during operation by the floatation-guiding means—and transporting the sheet into the stacking position.

Within the scope of the invention, it is further preferably provided that the pneumatic conveyor system comprises suction-tape arrangements, said suction-tape arrangements accepting a sheet, released by the chain-conveyor system, at unchanged speed and, depending on the position of the copy diverter, transporting the sheet onwards towards one of the floatation-guiding means.

In a further development of the invention, it is further provided that braking apparatuses are provided, said braking apparatuses acting on a bottom side of a sheet more or less at the level of the stacking position and braking each sheet before it reaches its stacking position; that the braking apparatuses comprise endless revolving braking tapes and, associated therewith, suction boxes, over which suction boxes the braking tapes are guided; and that blast-air nozzles are provided, said blast-air nozzles lowering the trailing end of each sheet by means of controlled blast-air jets and bringing said trailing end into contact with the braking tapes. In addition to the mere braking effect as a result of the lowering of the trailing end of the sheet, this design of braking apparatuses further guarantees that a following sheet does not collide with a preceding sheet while the preceding sheet is momentarily in its deposition position.

A further embodiment of the invention is characterized in that further blast-air nozzles are provided, said further blast-air nozzles forming an air cushion under the sheets leaving the braking apparatuses.

Open jets escaping from said blast-air nozzles produce an air cushion between the sheets already deposited on the stack and a sheet leaving the braking apparatus, said air cushion guaranteeing the smear- and scratch-free delivery of the sheet on the particular stack level.

In an advantageous further development of the invention, it is provided that the first stack level is formed by means of a first floatation-guiding apparatus, said floatation-guiding apparatus diverting each sheet—by means of an air stream between a bottom side of the sheet and the floatation-guiding apparatus, said air stream being produced by the first floatation-guiding apparatus when in an activated state—in an output direction oriented transversely with respect to the main conveying direction. The thereby taken measures make it possible, in particularly simple and user-friendly manner, for reject sheets, in particular, to be segregated from a continuous stream of sheets from a sheet-fed rotary printing press and for them to be disposed of. For this purpose, in the simplest case, the floatation-guiding apparatus that diverts the sheets may be followed by a collection container for reject sheets, it being easily possible for such a collection container to be installed on an appropriate side of the stack apparatus.

A further embodiment provides that the first floatation-guiding apparatus comprises a guide section, said guide section projecting laterally beyond the stack apparatus. Through a design of the guide overhang of corresponding length, this makes it possible to determine at what lateral distance from the stack apparatus to provide a disposal station for reject sheets, such disposal station being equipped, for example, with the aforementioned collection container.

A further advantageous embodiment also makes it possible to achieve the orderly deposition of laterally diverted sheets. This embodiment is characterized in that a third stack level is provided, said third stack level—as viewed in the output direction—following the guide section and being at a lower level in relation to the first stack level; that disposed above the guide section is a second floatation-guiding apparatus, said floatation-guiding apparatus at least partially covering said guide section, said floatation-guiding apparatus accepting each sheet—by means of an air stream between a top side of the sheet and the second floatation-guiding apparatus, said air stream being produced by the second floatation-guiding apparatus when in an activated state—from the first floatation-guiding apparatus and conveying said sheet onwards in the output direction into an output position above the third stack level; and that the second floatation-guiding apparatus is associated with a cycled sheet holder-down, said sheet holder-down pressing downwards the trailing end of each sheet, said sheet being at least more or less in the output position, the third stack level preferably being provided for the deposition of reject sheets and/or inspection sheets.

In the event of a non-stop apparatus being associated with the stack apparatus, it is preferably provided that the non-stop apparatus is disposed on a side of the stack facing the chain-conveyor system. This saves space and provides better clarity in the operating region of the stack apparatus.

In pursuance of the basic idea of the invention, aimed at the division of functional units, it is further preferably provided in a device according to the invention equipped with a drying apparatus in the delivery region that drying stations of modular construction are integrated into the chain-conveyor system. To this end, a preferred embodiment is characterized in that drying modules are formed by a horizontal branch of the chain-conveyor system and drying stations associated therewith, on the one hand, and by an inclined branch of the chain-conveyor system and drying stations associated therewith, on the other hand, some of said drying modules abutting joints and others following the stack apparatus and an end section of the sheet-fed rotary printing press, said end section comprising the last sheet-conducting cylinder.

Such a construction opens up a further possible embodiment in which the chain-conveyor system is adapted to be extended through the insertion of a further drying module at a joint.

Hereinbelow, details of the invention are explained with reference to the drawings, in which:

DESCRIPTION OF THE PREFERRED EMBODIMENTS

Figure 1:
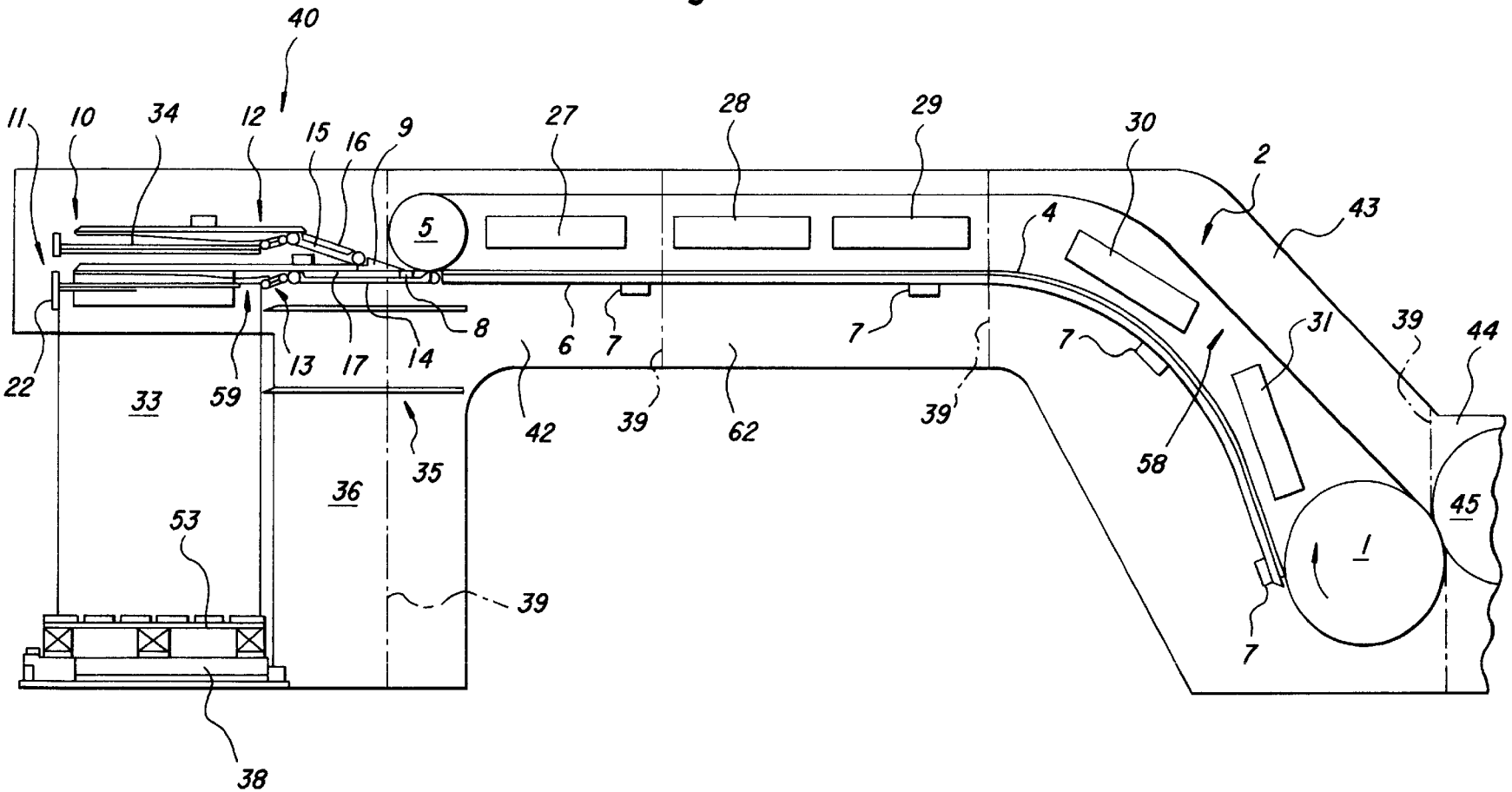
FIG. 1 shows a side view of the delivery region.

Coming from a last sheet-conducting cylinder 45 of a printing or finishing unit (preceding the delivery region and not shown in any greater detail in FIG. 1), sheets 24 in the circumferential region of a delivery drum 1 are accepted by a chain-conveyor system 58, are transported along a conveying distance (following a slack side 4 of a conveyor-chain arrangement 2 of said chain-conveyor system 58) in a main conveying direction directed towards the stack apparatus 40 and are released on a stack base 53 (situated in the stack apparatus) in order to form a stack 33. The chain-conveyor system 2 releases each sheet in the region of a chain reverser 5 at one end (remote from the delivery drum 1) of the chain-conveyor system 58. Extending from the delivery drum 1 as far as the chain reverser 5 is preferably a continuous floatation-guiding arrangement 6, which comprises a closed surface (following the course of the slack side 4) with individual air-passage openings. The floatation-guiding arrangement 6 is supplied with a suitable blast medium through a plurality of connection ports 7. The chain reverser 5 is followed by a copy diverter, consisting of diverting segments 8 (embedded in a suction-tape arrangement 14, 17, 37 to be explained in greater detail hereinbelow) and of adjoining wedge 9. A sheet 24 that has been released in the region of the chain reverser 5 is—depending on the position of the diverting segments 8—transported either by means of a further suction-tape arrangement 15, 16, 37, 38 (similar to the above-mentioned suction-tape arrangement) towards a first stacking position above a first stack level 10 or by means of the suction-tape arrangement 14, 17, 37 towards a second stacking position above a second stack level 11. In this connection, each stacking position is defined by the position of the respective floatation-guiding means 25, 26 (described hereinbelow). A stack of reject copies may be formed on the stack level 10, this being of importance especially during the proof-printing phase of a sheet-fed rotary printing press. Conversely, the formation of a stack 33 of good sheets during production printing takes place at the stack level 11. Both stack levels are each associated with a braking apparatus 12, 13 as well as with stops 32 for aligning the sheets that are to be stacked. During production printing, after the stacked reject sheets have been removed, it is possible for inspection sheets from the on-going production to be directed via diverting segments 8 onto the upper stack level 10 and to be stacked with straight-edged accuracy. The inspection sheets that have been collected at the upper stack level 10 can then be removed in ergonomically advantageous manner without risk of injury. Situated below the main stack 33 is preferably a pallet-conveying apparatus 38, with which the stack 33 can be removed from the stacking region in a direction transverse to the main conveying direction, while a non-stop apparatus 35 (indicated merely schematically here) allows the uninterrupted delivery of the sheets 24 at the stack level 11.

The fact that said non-stop apparatus is disposed on the side of the stack 33 facing the chain-conveyor system 58 means that there is no impairment of the accessibility of the stack apparatus 40.

Figure 2:
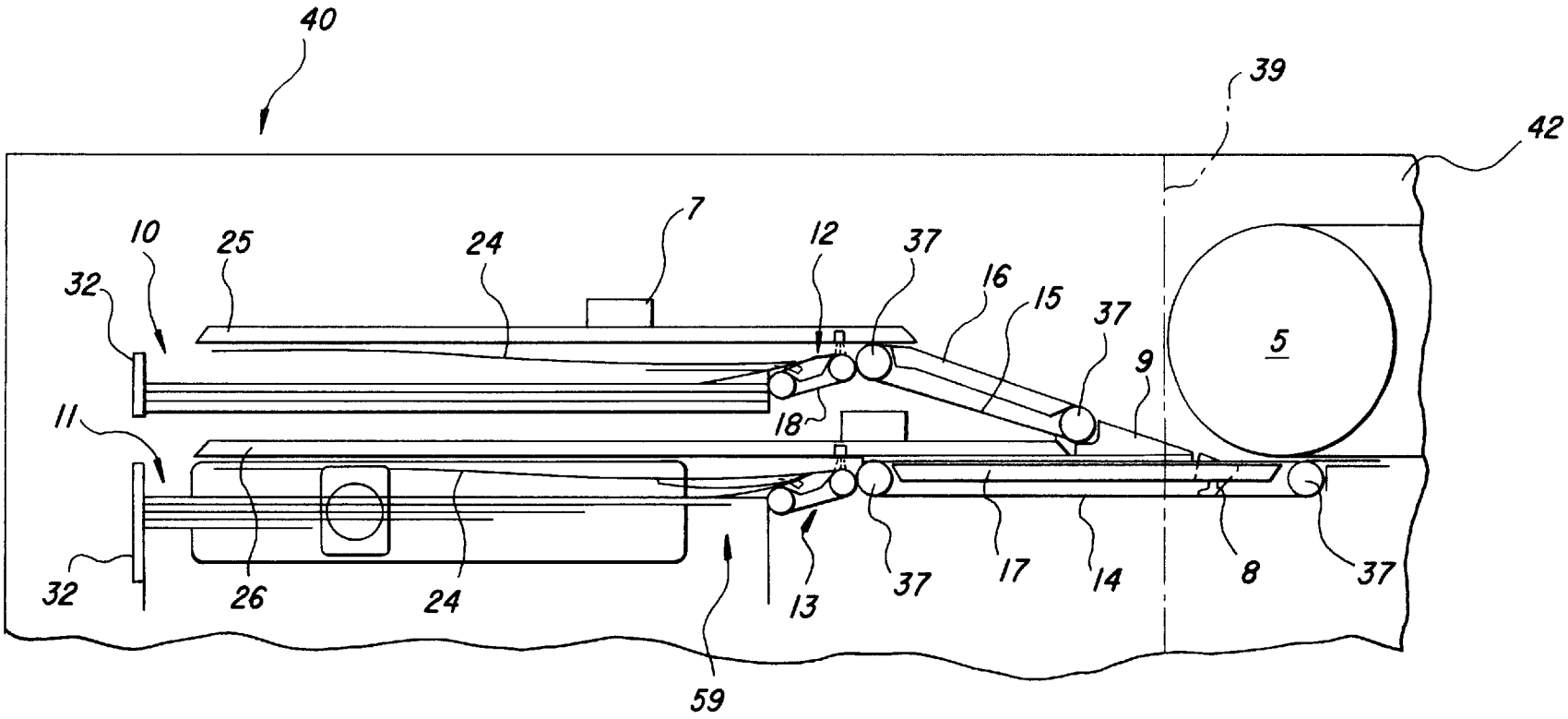
FIG. 2 shows an enlarged representation of a detail from FIG. 1.
Figure 3:
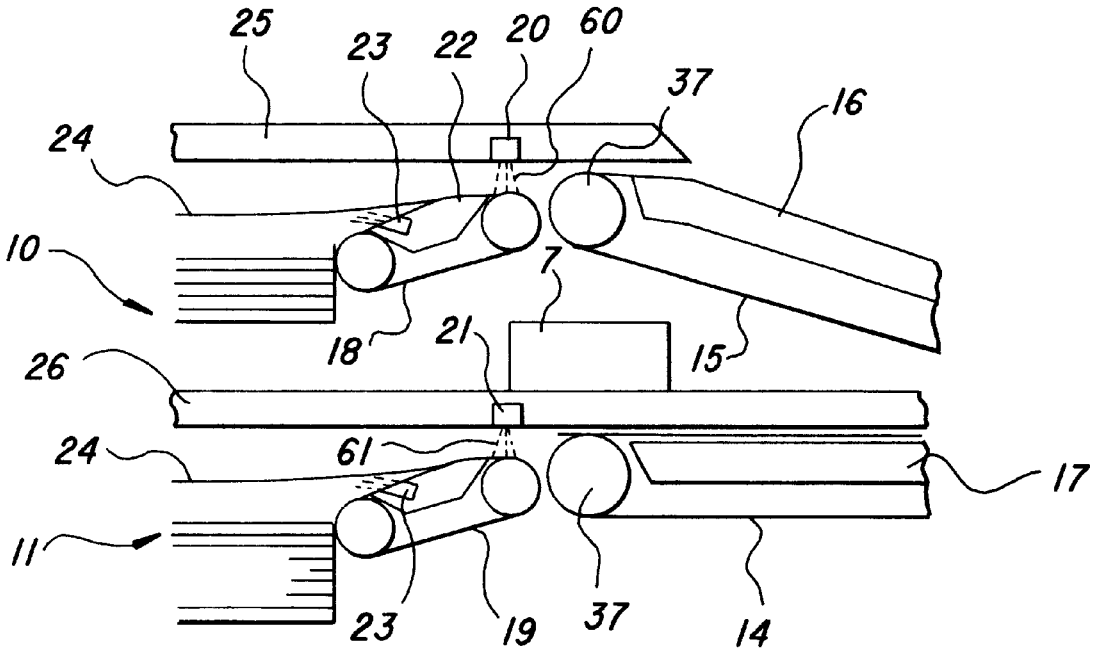
FIG. 3 shows an enlarged representation of a detail from FIG. 2.

As can clearly be seen particularly from FIG. 2, suction tapes 14 extend from below the chain reverser 5 as far as a braking apparatus 13. The suction tapes 14 are guided over one or more suction boxes 17 (disposed side by side in a direction perpendicular to the drawing plane in FIG. 2) and pass over guide pulleys 37; shown between the suction boxes 17 is one of the diverting segments 8, which are followed (as viewed in the main conveying direction) by a wedge 9 corresponding to the inclination of a suction tape 15. The suction tapes 14 are adjoined by a braking apparatus 13. Provided above the suction tapes 14 and the braking apparatus 13 in the direct vicinity thereof are floatation-guiding means 26 extending to above the stack 33 or the stack base 53. Said floatation-guiding means 26 are preferably in the form of an assemblage of hollow sections lying in one and the same horizontal plane and extending in the aforementioned main conveying direction. They are supplied during operation with blast air through a compressed-air connection port 7, said blast air escaping through nozzles on the underside of each hollow section in the form of an open jet with a central jet directed more or less in the main conveying direction. Such floatation-guiding means are known, for example, from the publication DE 39 36 846 C1 and are used for the floating (contact-free) transport of flat products, such as the sheets 24 in question here. Above the braking apparatus 13, blast-air nozzles 21 are let into said floatation-guiding means 26. With the diverting segments 8 in a position not inclined (unlike the position shown in FIG. 2), the sheets 24 are passed, during production printing, via the suction tapes 14 to the braking apparatus 13. By means of the controlled blast-air jets 61 escaping from the blast-air nozzles 21, the trailing end of each sheet 24 is brought into contact with the endless revolving braking tape 19 (see FIG. 3) of the braking apparatus 13. Since the braking apparatuses 12, 13 and the suction-tape arrangements 14, 15, 16, 17, 37 are of similar construction and have the same operating principle with differences merely in the tape speeds of the braking tapes 18, 19, on the one hand, and of the suction tapes 14, 15, on the other hand, the bringing-into-contact of the trailing end of a sheet with the braking tape 19—accompanied by a corresponding increase in the suction effect of the braking apparatus 13—initiates the braking of the respective sheet 24 without slippage in relation to the braking tape 19. After leaving the braking apparatus 13, the sheet 24, now braked,—while being guided by means of the floatation-guiding means 26 and under the influence of a certain carrying effect from an air cushion on the bottom side of the sheet 24—quickly reaches its stacking position, from which it then drops onto the stack level 11. The aforementioned air cushion is produced by means of further blast-air nozzles, which can be seen most clearly in FIG. 3.

The dropping of each preceding sheet 24 from its stacking position is initiated or favoured by the following sheet 24, which gradually denies the preceding sheet 24 the influence of the suction effect of the floatation-guiding means 26 in that the following sheet 24 penetrates—from the trailing end of the preceding sheet 24, which is pressed downwards onto the braking apparatus 13—between said preceding sheet 24 and the floatation-guiding means 26. Overall, therefore, it is possible for the sheet 24 to be guided contactlessly over the already stacked sheets 24 and for it to be deposited thereon, thereby preventing smearing and scratching phenomena.

If, conversely, a sheet 24 is supplied by means of the diverting segments 8 and the wedge 9 to the upper suction tapes 15 (which likewise run over guide pulleys 37), said sheet 24 comes in a manner similar to that described above into a stacking position above the stack level 10. On the there provided braking apparatus 12, the sheets 24 are decelerated in a manner similar to that described above. The sheets 24 deposited thereon may, for example, be reject copies that occur during the startup phase of the sheet-fed rotary printing press. During the production run of the press, inspection copies are passed—after appropriate resetting of the diverting segments 8—to the upper stack level 10, from where they can be removed considerably more easily than in the case of a continuous delivery onto the stack 33. The stack level 10 is likewise associated with a floatation-guiding means 25, which extends from the suction box 16 via the braking apparatus 12 approximately as far as the stop 32.

As already mentioned hereinbefore, the individual sheets 24 (which are to be transported onto one of the stack levels 10 or 11) are conveyed through the intermediary of the suction tapes 14 and 15. The suction tapes 14 and 15, which revolve around guide pulleys 37, move over the suction boxes 16 and 17, which are disposed beneath the suction tapes 14 and 15. Owing to the suction effect emanating from said suction boxes 16 and 17, the sheets 24 are not left to themselves, but, rather, are subjected to the action of a defined force, this making it possible to achieve controlled guiding. Extending above the stack levels 10 and 11 are respective floatation-guiding means 25 and 26, a controlled blast-air nozzle 20 and 21 being let into each of said floatation-guiding means 25 and 26 at the height of the top side of below-lying guide pulleys 37. The lower floatation-guiding means 26 extend over a long region of the suction tape 14, while the upper floatation-guiding means 25 still encompass an end region of the suction tape 15. Consequently, the conveyed sheet 24 does not at any point in time remain left to itself, but is guided by partially overlapping elements.

Accordingly, after the sheets 24 have passed the diverting segments 8, it is guaranteed that they are continuously subjected to an aerodynamically produced effect, this providing defined guiding of the sheets 24 in the stack apparatus 40, without this necessitating any rotating gripper bars.

Figure 4:
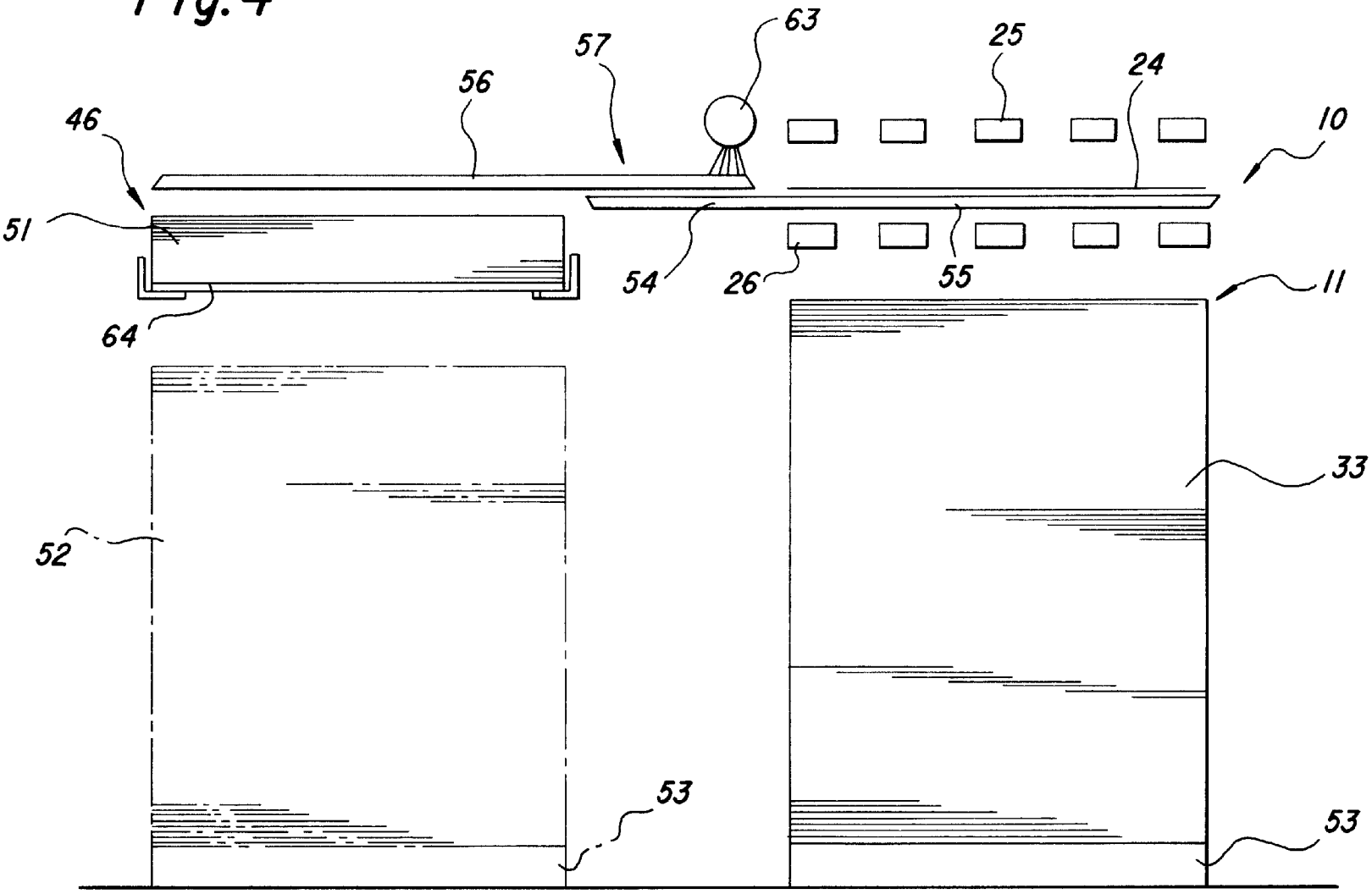
FIG. 4 shows a schematic view towards the (in FIG. 1 left-hand) end face of the delivery region, said delivery region being equipped with means according to the invention for the lateral diversion of sheets.

In a further development of the invention shown schematically in FIG. 4, the first stack level 10 is formed by means of a floatation-guiding apparatus 55. Said floatation-guiding apparatus 55 is of a form similar to the hereinbefore-described floatation-guiding means 26 and differs therefrom in that the nozzles are provided on the top side of each hollow section, in that the hollow sections extend transversely to the main conveying direction, in that the open jets escape from the nozzles with a central jet directed more or less likewise transversely to the conveying direction, and further in that they are not supplied with blast air during normal operation, but are merely activated through a corresponding supply of blast air for the purpose of the lateral diversion of sheets 24 that have dropped onto the first stack level 10. As can be seen from FIG. 4, the floatation-guiding apparatus 55 projects laterally beyond the stack apparatus 40 (here represented by the stack 33), said lateral projection being provided by a guide section 54 of the floatation-guiding apparatus 55. This provides for the disposal of diverted reject sheets through the transport thereof to a place at the side of the stack apparatus 40 and at a sufficient distance from the stack apparatus 40, at which place it is possible, if required, to install a waste container.

Provided for the orderly deposition of sheets 24 that are diverted laterally by means of the floatation-guiding apparatus 55 is a third stack level 46, which, as viewed in the output direction extending transversely to the main conveying direction, adjoins the guide section 54. Such a third stack level 46 is formed, for example, by an, as required, location-fixedly or height-adjustably disposed carrying plate 64 or by a top side of a thereon already existing part-stack of, for example, reject sheets or inspection sheets. Given appropriate setting of the diverting segments 8 (FIG. 2), these sheets are first of all supplied in the main conveying direction to the first stack level 10, from where they are diverted by means of the floatation-guiding apparatus 55 into an output direction extending transversely to the main conveying direction and are subjected to the influence of a second floatation-guiding apparatus 56. The second floatation-guiding apparatus 56, in turn, is of a design similar to the hereinbefore-described floatation-guiding means 26 and differs therefrom principally in that, as a result of corresponding orientation of the aforementioned hollow sections and of the open blast-air jets (escaping from the bottom sides thereof) towards a top side of a sheet 24 situated in the region of influence of said open blast-air jets, said second floatation-guiding apparatus 56 exerts a conveying effect in the output direction extending transversely to the main conveying direction. The conveying effects (exerted on a sheet 24) of the floatation-guiding apparatus 55 and of the second floatation-guiding apparatus 56 are thus identically directed and augment each other in an overlap region designated as 57 in FIG. 4, in which overlap region the aforementioned guide section 54 is covered by the second floatation-guiding apparatus 56, said second floatation-guiding apparatus 56 being disposed above the guide section 54. It is perfectly possible for the extent (viewed in the output direction) of the overlap region 57 to be made shorter than the corresponding extent of the guide section 54. With regard to the dimensioning of the overlap region 57, it is merely essential that a sheet 24 is transferred from the floatation-guiding apparatus 55, acting on the bottom side of said sheet 24, to the second floatation-guiding apparatus 56, acting on the top side thereof, said second floatation-guiding apparatus 56 then conveying an accepted sheet onwards into an output position above the third stack level 46.

As becomes apparent from the aforesaid, the third stack level 46 is not provided for forming the stack 33 (of good sheets). Consequently, the floatation-guiding apparatuses 55 and 56 are not normally supplied with compressed air during operation, but are activated as and when required. However, it is perfectly possible for a part-stack 51 of sheets following each other in phase with the press to be deposited on the carrying plate 64, which is situated below the output position defined by the second floatation-guiding apparatus 56. For this purpose, it is necessary for a preceding sheet 24 to be released from its output position directly below the second floatation-guiding apparatus 56 and for it to drop onto the third stack level 46. For this purpose, the third stack level 46 is disposed at a lower level than the first stack level 10.

As already explained in conjunction with the blast-air nozzles 20, 21 (FIG. 3), said dropping of the sheet 24 is initiated or favoured by the fact that a following sheet 24 is pushed into a gap between the top side of a preceding sheet 24 and the bottom side of the second floatation-guiding apparatus 56, thereby cancelling the influence thereof on the preceding sheet 24. The penetration of the following sheet 24 into the aforementioned gap is, in turn, favoured by the fact that the trailing end of the preceding sheet 24 is pressed downwards by means of a cycled sheet holder-down 63. For this purpose, a corresponding sheet holder-down 63 is associated with the second floatation-guiding apparatus 56 and is, for example, in the form of a roller with brush segments or in the form of a blast-air tube with nozzles directed at the sheets 24.

As is further indicated in FIG. 4, part-stacks 51, formed in particular from reject sheets, may be combined, through the intermediary of suitable stack-uniting means (not shown), to form a reject stack 52, which may, until the disposal thereof, be disposed under the carrying plate 64.

In the case of a pallet-conveying apparatus 38 for the stack 33, said pallet-conveying apparatus 38 being oriented transversely to the main conveying direction and having already been indicated in conjunction with FIG. 1, it is advisable, however, for a part-stack 51 to be disposed of immediately after it reaches a defined height. In conjunction with a height-adjustable carrying plate 64, however, such height may still assume such proportions that, when lowered, the carrying plate 64 is approximately at the height of the bottom edges of sheet aligners provided in the stack apparatus 40.

As for the rest, with, in particular, the floatation-guiding apparatus 55 in a non-activated state, it is also possible for a part-stack 34 to be formed on the first stack level 10. Such a part-stack 34 of, if required, only a small number of sheets 24 provides an extremely user-friendly option for the removal of inspection sheets.

The basic idea of the invention, directed towards the division of functional groups, leads also—in the case of a delivery region of a sheet-fed rotary printing press equipped with a drying apparatus within the chain-conveyor system—to a strict separation between, on the one hand, functional groups associated with stack formation and, on the other hand, functional groups associated with the region of a drying section. If conventional devices of this kind are equipped with a drying apparatus, such functional groups are inseparably combined. Conversely, in a specimen embodiment of the invention, there is not only a strict structural separation of the aforementioned functional groups but also a modular construction of drying stations, said drying stations being integrated into the chain-conveyor system 58. Accordingly, in the aforementioned specimen embodiment according to FIG. 1, a first horizontal branch of the chain-conveyor system 58 and a drying station 57 associated therewith, a second horizontal branch of the chain-conveyor system 58 and drying stations 28, 29 associated therewith as well as an inclined branch of the chain-conveyor system 58 and drying stations 30, 31 associated therewith form drying modules 42, 62 and 43, the drying module 62 being inserted at a joint 39 in order to extend a drying section formed by the drying modules 42 and 43, with corresponding extension of the conveyor-chain arrangement 2. The drying modules 42, 62 abut each other at the aforementioned joint 39, the drying modules 63, 43 abutting each other at a further joint 39. Particular significance accrues to a further joint 39 at which the drying module 42 adjoins the stack apparatus 40. Namely, said joint embodies the separation (undertaken within the scope of the invention) of functional groups with regard to the formation of the stack 33. Also of similar significance is the joint 39 between the drying module 43 and the end section 44 of the sheet-fed rotary printing press with regard to the structural separation between the functional units for sheet delivery, on the one hand, and those for sheet processing, on the other hand.

Overall, therefore, the delivery region is divided into a sheet-transport region with a chain-conveyor system (possibly comprising drying stations) and a stack-forming region with a pneumatic conveyor system.

LIST OF REFERENCE CHARACTERS

1 Delivery drum
2 Conveyor-chain arrangement
3
4 Slack side
5 Chain reverser
6 Floatation-guiding arrangement
7 Connection port
8 Diverting segment
9 Wedge
10 First stack level
11 Second stack level
12 Braking apparatus
13 Braking apparatus
14 Suction tape
15 Suction tape
16 Suction box
17 Suction box
18 Braking tape
19 Braking tape
20 Blast-air nozzle (controlled)
21 Blast-air nozzle (controlled)
22 Suction box
23 Blast-air nozzle
24 Sheet
25 Floatation-guiding means
26 Floatation-guiding means
27 Drying station
28 Drying station
29 Drying station
30 Drying station
31 Drying station
32 Stop
33 Stack
34 Part-stack
35 Non-stop apparatus
36
37 Guide pulleys
38 Pallet-conveying apparatus
39 Joint
40 Stack apparatus
41
42 Drying module
43 Drying module
44 End section of rotary printing press
45 Cylinder
46 Third stack level
47
48
49
50
51 Part-stack
52 Reject stack
53 Stack base
54 Guide section of floatation-guiding apparatus 55
55 Floatation-guiding apparatus
56 Floatation-guiding apparatus
57 Overlap region
58 Chain-conveyor system
59 Pneumatic conveyor system
60 Blast-air jet
61 Blast-air jet
62 Drying module
63 Sheet holder-down
64 Carrying plate

What is claimed is:

1. Device for transporting and depositing sheets in a sheet-fed rotary printing press having pneumatic sheet-guiding elements disposed below a sheet-conveying path and extending across the entire width of a respective sheet and a chain-conveyor system for accepting sheets consecutively from a last sheet-guiding cylinder of the sheet-fed rotary printing press, for transporting the sheets along a conveyance distance in a main conveyance direction oriented towards sheet-stacking equipment, and for releasing the sheets after passing the conveyance distance, comprising a pneumatic conveyor system following the chain-conveyor system for conveying the sheets released from the chain-conveyor system along a respective one of selectable paths into a respective one of delivery positions located in a vicinity of the sheet-stacking equipment, said pneumatic conveyor system having a sheet diverter for selecting said respective one of said selectable paths, the respective sheets being releasable by said pneumatic conveyor system in said respective one of said delivery positions, so as to drop onto a respective one of stacking levels associated with said respective one of said delivery positions in order to build up a main pile and at least one auxiliary pile respectively.

2. Device according to claim 1, wherein a first one of said stacking levels is disposed above a second one of said stacking levels respectively formed by an upper side of said main pile and an upper side of a pile base adapted for bearing said main pile.

3. Device according to 2, in combination with a non-stop device, wherein said non-stop device is disposed at a side of the sheet pile facing towards the chain-conveyor system.

4. Device according to claim 2, in combination with a drying device associated with the chain-conveyor system, wherein drying stations of modular construction are integrated into the chain-conveyor system.

5. Device according to claim 4, wherein the chain-conveyor system has a respective horizontal branch and a respective inclined branch, each of said branches, together with respective drying stations associated therewith forming said drying modules, said drying modules, respectively, in part abutting at disconnecting locations and, in part connecting with the stacking equipment and an end section of the sheet-fed printing press which includes the last sheet-guiding cylinder.

6. Device according to claim 5, wherein a further drying module is inserted at one of said disconnecting locations for extending the chain-conveyor systems.

7. Device according to claim 1, wherein said pneumatic conveyor system comprises flotation guides, respectively, associated with each of said stacking levels for operatively producing an air stream for guiding the respective sheet leaving the sheet diverter between an upper side of the respective sheet and the flotation guides, and transporting the respective sheet into said respective one of said delivery positions.

8. Device according to claim 7, wherein said pneumatic conveyor system includes suction-tape arrangements for accepting with maintained speed the respective sheet released by the chain-conveyor system and, in accordance with a respective position of said sheet diverter, transporting the respective sheet onwards in a direction towards one of said flotation guides.

9. Device according to claim 7, including a floating guide forming an upper one of said stacking levels, said flotation guide being equipped for producing, in an activated condition thereof, an air stream between an underside of the respective sheet and said flotation guide for diverting the respective sheet, said air stream extending in an output direction oriented transversely to said main conveyance direction.

10. Device according to claim 9, wherein said flotation guide is formed with a guide section projecting laterally beyond said sheet-stacking equipment.

11. Device according to claim 10, wherein said stacking levels include first and second stacking levels and including another stacking level following said guide section, as viewed in sheet output direction, and being disposed at a level intermediate said first and said second stacking levels, another flotation guide disposed above said guide section of said first-mentioned flotation guide and at least partly covering said guide section, said other flotation guide being equipped for producing, in the activated condition thereof, an air stream between an upper side of the respective sheet and said other flotation guide for accepting the respective sheet from said first-mentioned flotation guide and for conveying the sheet onwards in said output direction into an output position located above said other stacking level, and a cycled sheet down-holder associated with said other flotation guide for pressing downwardly a respective trailing end of a respective sheet disposed at least approximately in said output position.

12. Device according to claim 11, wherein the respective sheets are selected by activating said other flotation guide from the groupings of sheets consisting of reject and inspection sheets which are acceptable for deposit at said other stacking level.

13. Device according to claim 1, including respective brakes for acting upon an underside of the respective sheet disposed substantially at the level of said respective one of said delivery positions for braking the respective sheet before it reaches said respective one of said delivery positions thereof, said respective brakes having endless revolving tapes and suction boxes associated therewith over which said revolving tapes are guidable, and including blast air nozzles for emitting controlled blast air jets for lowering a respective trailing end of the respective sheet so as to bring said trailing end into contact with said revolving tapes.

14. Device according to claim 13, including additional blast-air nozzles for forming an air cushion under the respective sheets leaving said brakes.

* * * * *